US006840174B2

(12) United States Patent
Harris et al.

(10) Patent No.: US 6,840,174 B2
(45) Date of Patent: Jan. 11, 2005

(54) DEBRIS SCREEN FOR A PRINTING PRESS

(75) Inventors: Paul Harris, York (GB); Eric Thompson, Leeds (GB)

(73) Assignee: R. R. Donnelley & Sons Company, Chicago, IL (US)

( * ) Notice: Subject to any disclaimer, the term of this patent is extended or adjusted under 35 U.S.C. 154(b) by 0 days.

(21) Appl. No.: 10/355,371

(22) Filed: Jan. 31, 2003

(65) Prior Publication Data

US 2004/0149153 A1 Aug. 5, 2004

(51) Int. Cl.[7] ..... B41F 35/00
(52) U.S. Cl. ..... 101/425; 101/483; 101/423
(58) Field of Search ..... 101/423–425, 101/483; 15/256.51, 256, 256.52; 134/104.2, 104, 104.3; 399/34, 123, 343, 357, 358

(56) References Cited

U.S. PATENT DOCUMENTS

| | | | | |
|---|---|---|---|---|
| 1,616,556 A | | 2/1927 | Smith | 430/98 |
| 2,274,167 A | | 2/1942 | Roesen | 101/349.1 |
| 3,615,397 A | | 10/1971 | Diamond et al. | 101/425 |
| 3,771,450 A | | 11/1973 | Cleybergh | 101/425 |
| 4,454,812 A | * | 6/1984 | Johne et al. | 101/212 |
| 4,669,380 A | * | 6/1987 | Seib et al. | 101/216 |
| 5,243,910 A | | 9/1993 | Burch | 101/425 |
| 5,289,774 A | | 3/1994 | Stanka | 101/423 |
| 5,404,819 A | | 4/1995 | Hishinuma et al. | 101/425 |
| 5,705,447 A | | 1/1998 | Kubo | 442/334 |
| 5,842,411 A | | 12/1998 | Johnson | 101/36 |
| 5,875,714 A | * | 3/1999 | Winkler et al. | 101/216 |
| 6,101,943 A | | 8/2000 | Hara et al. | 101/425 |
| 6,219,879 B1 | | 4/2001 | Oyaizu et al. | 15/256.51 |
| 6,360,660 B1 | | 3/2002 | Allison, Jr. | 101/169 |
| 6,401,608 B1 | * | 6/2002 | Lyon et al. | 101/136 |

* cited by examiner

*Primary Examiner*—Anthony H. Nguyen
(74) *Attorney, Agent, or Firm*—Grossman & Flight, LLC.

(57) ABSTRACT

A debris screen for a printing press having an ink roller train and a paper pathway includes a source reel, a collecting reel, and at least one transfer roller mounted to a supporting frame, a sheet of flexible material extending along a sheet path from the source reel, over the transfer roller, and to the collecting reel, the transfer roller positioned on the frame such that the sheet path extends between a portion of the ink roller train and the pathway for the paper web.

30 Claims, 5 Drawing Sheets

DEBRIS SCREEN FOR A PRINTING PRESS

FIELD OF THE INVENTION

The present invention relates generally to printing presses and, more particularly, to a debris screen for use on a rotary offset printing press and other web-fed printing presses.

BACKGROUND OF THE INVENTION

Web-fed printing presses, such as rotary printing presses having rotatable cylinders, such as plate cylinders, blanket cylinders, and impressions cylinders, are generally well known in the art. Such presses apply printed images to a continuous web of paper which runs through the press at very high speeds. On a rotary offset printing press, the web of paper passes between a rotating blanket cylinder and a rotating impression cylinder, such that an image is transferred from the blanket cylinder to the web. Other types of printing presses exist that use similar principles, such as, for example, blanket to blanket printing presses. These other types of printing presses also are typically web-fed units.

Such rotary printing presses include an ink roller train. The ink roller train typically includes a system of dampening rollers and inking rollers, which are used to transfer ink to the plate cylinders. The inked plate cylinder then transfers the image to the blanket cylinder, which then applies the image to the continuous web. As is known, these dampening and inking rollers may rotate at relatively high speeds, and under certain conditions ink or other debris may be thrown from the ink roller train. Sometimes, the ink or other debris comes into contact with the web, which adversely impacts print quality and in some circumstances can cause the web to break. In either case, the efficiency of the printing operation is negatively impacted.

DETAILED DESCRIPTION

Figure 1:
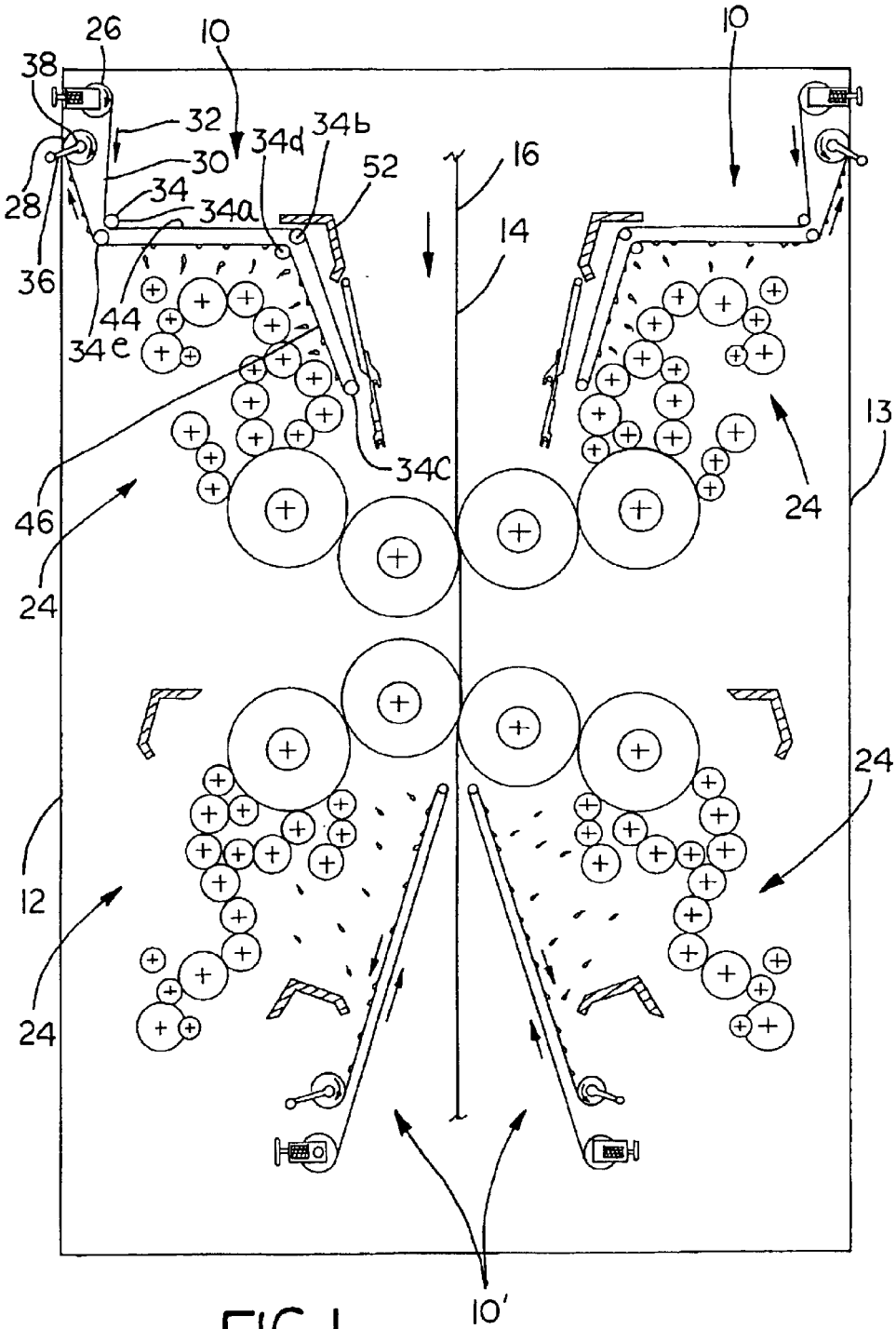
FIG. 1 is an elevational view, partly in section, of a printing station in a rotary offset printing press and illustrating a pair of debris screens assembled in accordance with the teachings of the present invention.
Figure 3:
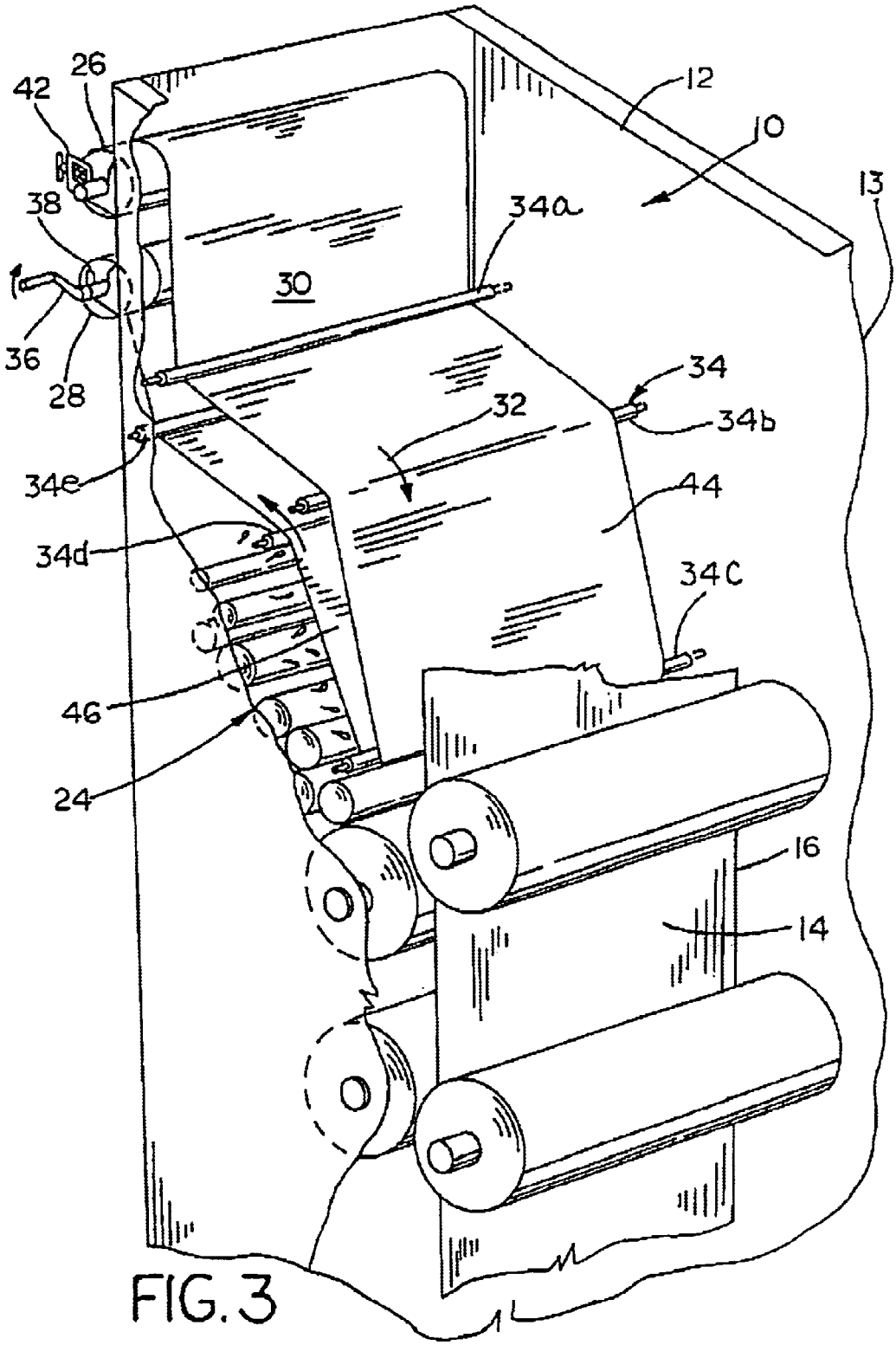
FIG. 3 is an enlarged perspective view of the debris screen shown on an exemplary support frame.

Referring now to the drawings, FIGS. 1 and 3 illustrate a debris screen 10 assembled in accordance with the teachings of an exemplary embodiment of the present invention and shown installed on a printing press 12. The printing press 12 generally defines a web path 14 along which travels a paper web 16. The web path 14 passes between a plurality of rollers or cylinders commonly found on printing presses, including plate cylinders 18, blanket cylinders 20, and impression cylinders 22. The printing press also includes a plurality of ink roller trains 24. In the printing press 12 shown in FIG. 1, four individual ink roller trains 24 and a single printing station are shown. It will be understood that the printing press 12 may include additional printing stations and additional or fewer ink roller trains depending on the size of the printing press 12 and other known design considerations.

Referring still to FIGS. 1 and 3, the debris screen 10 includes a source reel 26, a collecting reel 28, and a flexible sheet 30 extending between the source reel 26 and the collecting reel 28 along a material path 32. The flexible sheet 30 is preferably a woven fabric material, such as a blanket wash cloth available from Baldwin Technolgy Co., Inc., of Shelton, Conn. Such a wash cloth exhibits suitable strength requirements when under tension, is absorbent, and is readily available in suitable widths. Other suitable materials may be chosen. Alternatively, a heavy paper material may be used, such as may be readily available in the printing arts.

In the exemplary debris screen 10 shown in the upper left and upper right quadrants of FIG. 1 and in FIG. 3, the debris screen 10 includes a plurality of transfer rollers 34, with five such transfer rollers 34*a*, 34*b*, 34*c*, 34*d* and 34*e* being shown. The transfer rollers need not actually pivot or roll about an axis, but instead may be generally stationary provided they have a suitably smooth or low friction surface that permits the sheet 30 to slide freely. It will be noted that a slightly altered example of the debris screen shown is in the lower left and lower right quadrants of FIG. 1, which will be referred to as the debris screens 10'. The debris screens 10' differ from the debris screens 10 only in the number of transfer rollers 34 and in the position of the debris screen within the printing press 12. Thus, in the interest of brevity only the debris screens 10 need be discussed in detail herein, it being understood that the debris screens 10' are similar in all respects to the debris screens 10 except for the noted exception. Also, when viewing FIGS. 1 and 3, it will be noted that at least a portion of the sheet path 32 is disposed between the ink roller train 24 and the web path 14.

Figure 2:
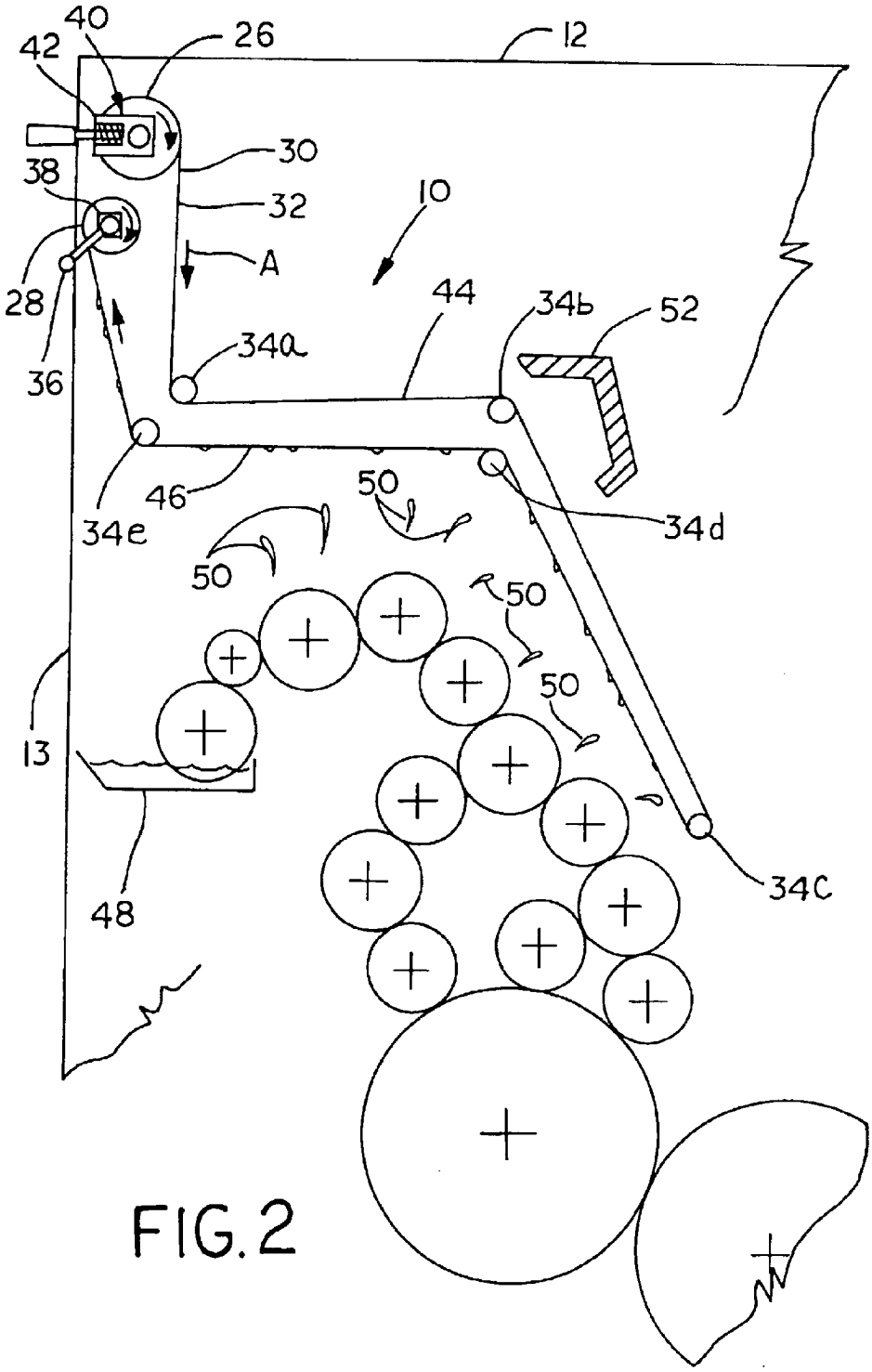
FIG. 2 is an enlarged fragmentary elevational view of a debris screen assembled in accordance with the teachinsg of the invention.

Referring now to FIG. 2, the exemplary debris screen 10 shown in the upper left quadrant of FIG. 1 is illustrated in greater detail. The collecting reel 28 includes a handle 36 for advancing the flexible sheet 30 along the sheet path 32. In the disclosed example, the handle 36 is turned in a clockwise direction in order to advance the sheet 30 along the path 32, with the sheet 30 proceeding in order over the transfer rollers 34*a* through 34*e* in a direction A. The collecting reel 28 may also be provided with a ratchet and pawl mechanism 38 (shown in greater detail in FIG. 6), or any other suitable mechanism such as, for example, a clutch mechanism (not shown), such that the flexible web will not appreciably backtrack along the sheet path 32. Preferably, the source reel 26 is provided with a tensioning mechanism 40 which, in the disclosed example, includes a brake 42 on the roller 26 and the ratchet and pawl mechanism 38 on the roller 28. Othe suitable systems may be provided for maintaining a desired tension on the sheet 30. An example of a suitable tensioning or friction system is discussed in greater detail below.

The tensioning mechanism 40, if provided, helps to maintain a suitable tension on the flexible sheet 30. Thus, after advancing the flexible sheet 30 along the sheet path 32, the sheet 30 will not sag appreciably between adjacent transfer rollers 34. As stated above, the tensioning mechanism 40 may take the form of a brake 42 (FIGS. 2 and 3). When advancing the flexible sheet 30 using the handle 36 on the collecting reel, it may be necessary to release the brake 42.

Alternatively, the tensioning mechanism 40 may take the form of a spring washer assembly (shown in FIG. 7 and described in greater detail below), or may take the form of a suitable friction hub (not shown), or any other suitable mechanism, which would not need to be affirmatively released. It will be understood that the sheet 30 remains essentially stationary except when being advanced along the path 32. Alternatively, the sheet 30 of the debris screen 10 may be made to advance continuously at a suitably slow speed using a suitable drive mechanism, or the sheet 30 may be made to advance a selected distance automatically at selected time intervals.

Referring to FIG. 2, it is evident that at least a portion of the sheet path 32 extends between the ink roller train 24 and the web path 14 of the printing press. Also, a first portion 44 of the exposed web 32 (the portion between the transfer roller 34*c* and the collecting reel 28) is disposed generally adjacent to the ink roller train 24, while another portion 46 of the exposed sheet 30 (the portion between the source reel 26 and the transfer roller 34*c*) is disposed between the first portion 44 and the web path 14.

When viewing FIGS. 1 through 3, it will be understood that the ink roller train 24 includes a plurality of relatively small diameter rollers which work to convey an ink or emulsion ink solution from an ink source 48 (FIG. 2) to the appropriate roller(s)/cylinder(s) in a known manner. As is known to those of skill in the art, one or more of these individual roller(s)/cylinder(s) may spin at speeds sufficient to throw off debris 50. The debris may be ink or emulsion ink solution, or may take the form of dried ink or other debris that has gathered in the ink roller train 24. At times, at least a portion of this debris 50 may be thrown in the general direction of the web path 14. In the disclosed example, the debris 50 is caught or intercepted by the first portion 44 of the exposed sheet 30. Thus, the first portion 44 of the sheet 30 eventually becomes contaminated with the debris 50. At a suitable time, the contaminated portion may be advanced onto the collecting reel 28, which brings a newer portion of the sheet 30 into position to catch additional debris 50.

It will be understood that the transfer rollers 34 may be suitably mounted to a frame 13 of the printing press so as to route the sheet path 32 through the interior spaces of the printing press 12 such that the sheet path 32 and the sheet 30 can avoid interferences. These interferences may take the form of interior frame supports 52 (FIGS. 1 and 2) or other cross members, structures, etc., that typically may be found within the printing press 12.

It can be seen that each of the source reel 26 and the collecting reel 28 are suitable mounted to a portion of the frame 13 of the printing press 12. Preferably, each of the source reel 26 and the collecting reel 28 is removably mounted to the frame, such that the reels 26, 28 may be replaced when all of the flexible sheet 30 has been contaminated by debris 50. The reels 26, 28 may be removably mounted to the frame 13 using a suitable removable mechanism, such as mounting bolts, etc., of the type commonly employed for mounting rolls of paper to a supporting frame.

Figure 4:
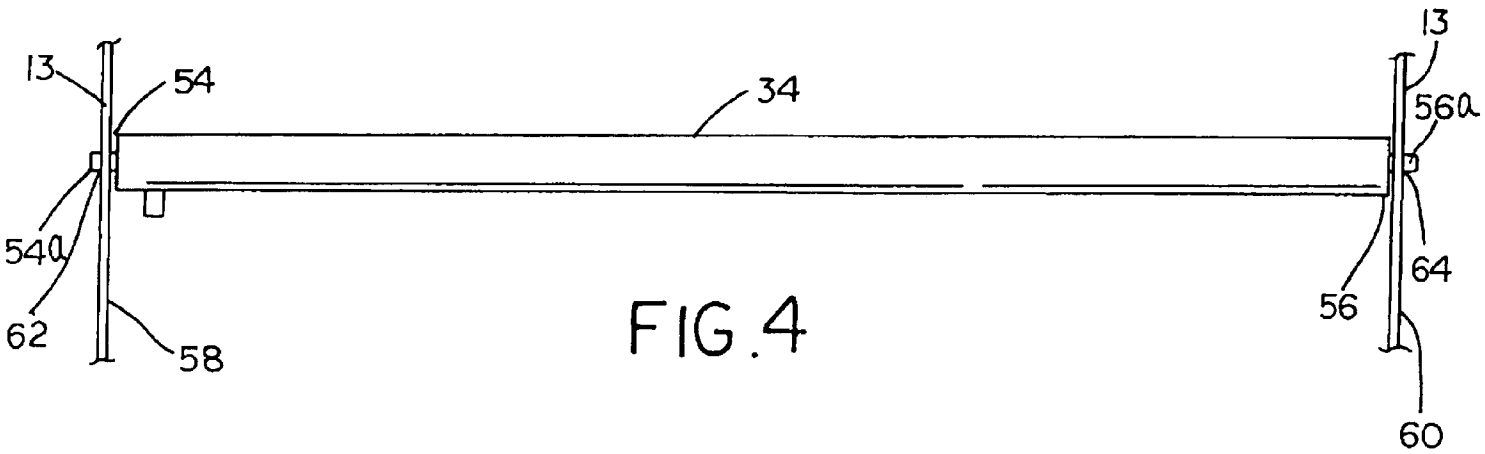
FIG. 4 is an elevational view taken along lines 4—4 of FIG. 3 and illustrating one possible manner of securing a transfer roller to a supporting frame.
Figure 5:
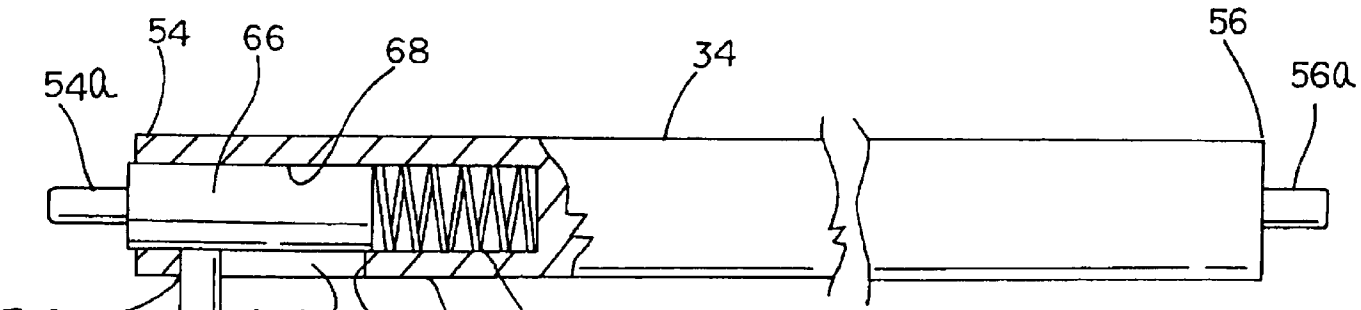
FIG. 5 is an elevational view taken along line 5—5 of FIG. 4 and illustrating an exemplary transfer roller release mechanism.

Referring now to FIGS. 4 and 5, an exemplary one of the transfer rollers 34 is shown. The transfer roller 34 includes a pair of ends 54, 56, each of which is suitably supported on adjacent portions 58, 60, respectively, of the frame 13 of the press 12. Alternatively, the ends 54, 56 may be supported on any other suitable supporting frame (not shown) that may be retrofitted within the printing press 12. In the disclosed example, the ends 54, 56 are provided with pins 54*a*, 56*a*, respectively, which are sized to fit within suitable apertures 62, 64, respectively, on the supporting portions 58, 60 of the frame 13. Other suitable mounting mechanisms may be employed. The transfer rollers may be rotationally mounted to the frame 13 or, as an alternative, the transfer rollers may by stationary, with the sheet 30 frictionally passing over the transfer rollers 34.

In the example shown in FIG. 5, at least one of the pins, for example, the pin 54*a*, preferably is retractable. The pin 54*a* is mounted to a cylinder 66 which is reciprocally disposed within a cylindrical cavity 68 inside of the transfer roller 34. The cylinder 66 will preferably be of larger diameter than the protruding end of the pin 54*a* so as to provide for smooth sliding within the cavity 68. A spring 70 is provided within the cavity 68 in order to bias the cylinder 66 and the pin 54*a* toward the left when viewing FIG. 5 toward an extended position. A tab 72 protrudes from a side portion of the cylinder 66 through a suitable slot 74 formed in a surface 76 of the transfer roller 34. The slot 74 includes a pair of ends 74*a* and 74*b*, such that the cylinder 66 and hence the pin 54*a* may be manipulated between the extended or mounting position shown in FIG. 5 and a retracted or dismounting position by moving the tab 72 toward the right within the slot 74. Thus the transfer roller 34 may be conveniently removed from the frame, thus enabling all or a portion of the web to be folded out of the way when, for example, servicing portions of the printing press 12.

Figure 6:
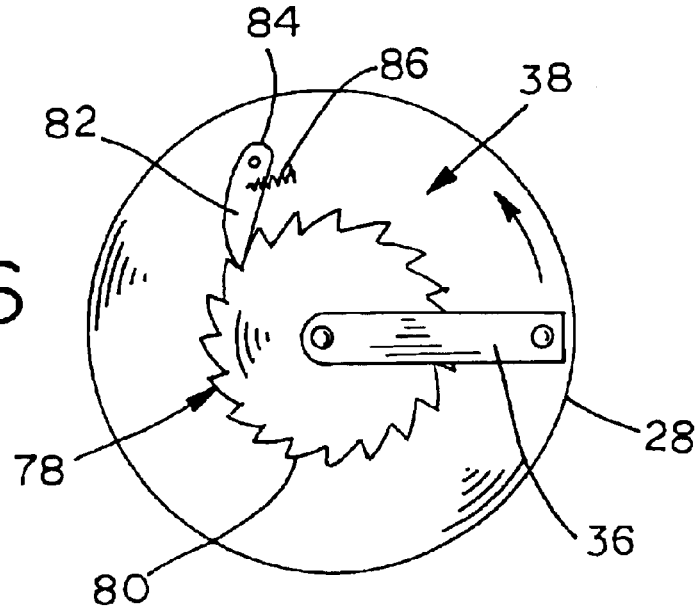
FIG. 6 is an enlarged fragmentary elevational view illustrating an exemplary ratchet mechanism.

Referring now to FIG. 6, an exemplary form for the ratchet and pawl mechanism 38 is shown therein in enlarged form. The ratchet and pawl mechanism includes a ratchet wheel 78 which is joined to the reel 28 so as to rotate therewith. The ratchet wheel includes a plurality of teeth 80. A pawl 82 is suitably affixed to the frame 13 by a pivot 84, and may include a spring 86 which helps to urge the pawl 82 into engagement with the teeth 80 of the wheel 78. In operation, when situated as shown in FIG. 6, rotation of the reel 28 is permitted in the counterclockwise direction by turning the handle 36 counterclockwise. However, the pawl 82 prevents appreciable rotation in the clockwise direction.

Figure 7:
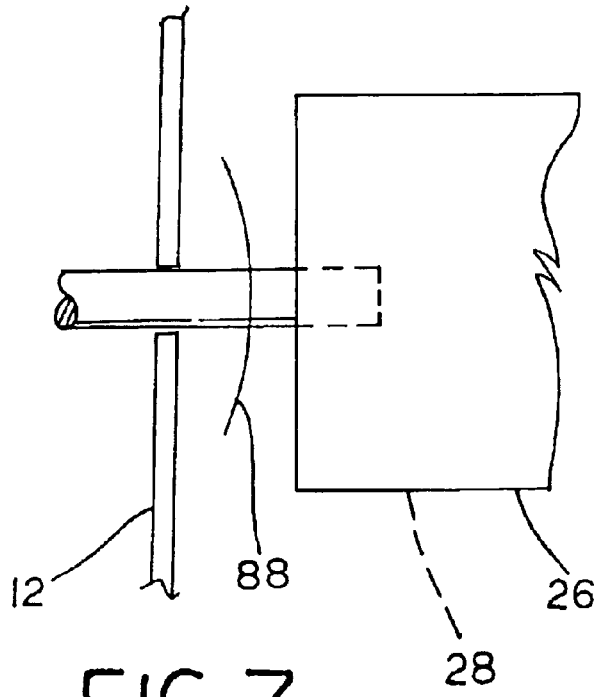
FIG. 7 is an enlarged fragmentary exploded elevational view of an exemplary brake or friction mechanism.

Referring now to FIG. 7, either one of the source reel 26 or the collecting reel 28 may be mounted to an adjacent portion of the frame 13 (or to any other suitable support) using a spring washer assembly 88, which is disposed between an end portion of the appropriate reel 26 or 28 and the adjacent portion of the frame 13. The spring washer 88, when positioned as shown or when positioned in any other suitable arrangement, will act as a brake, thus preventing the source reel 26 and/or the collecting reel 28 from feeding out an additional length of the sheet 30 unless sufficient force is applied (such as by using the handle 36) to overcome the friction on the reel 26 applied by the washer 88. The washer 88 may take a variety of forms, including a spring washer, a split washer, a friction washer, or any other suitable assembly.

Numerous modifications and alternative embodiments of the invention will be apparent to those skilled in the art in view of the foregoing descriptions. Accordingly, these descriptions are to be construed as illustrative only and are for the purpose of teaching those skilled in the art the best mode or modes presently contemplated for carrying out the invention. The details of the structure or structures disclosed herein may be varied substantially without departing from the spirit of the invention, and the exclusive use of all modifications which come within the scope of the appended claims, either literally or under the doctrine of equivalents, is reserved.

What is claimed is:

1. A debris screen for use with a printing press having an ink roller train and defining a pathway for a paper web, the debris screen comprising:

a frame;

a source reel and a collecting reel mounted to the frame;

at least one transfer roller mounted to the frame;

a sheet of flexible material, the sheet extending along a sheet path from the source reel, over the transfer roller, and to the collecting reel; and the transfer roller positioned on the frame such that at least a portion of the sheet path is disposed between the ink roller train and the pathway for the paper web.

2. The device of claim 1, wherein the flexible material is a woven fabric.

3. The device of claim 1, wherein the flexible material is advanceable between the source reel and the collecting reel.

4. The device of claim 3, wherein at least one of the source reel and the collecting reel includes a brake.

5. The device of claim 3, including tensioning means for maintaining a desired tension on the flexible material.

6. The device of claim 3, wherein the source reel includes a friction hub.

7. The device of claim 6, wherein the collecting reel includes a ratchet mechanism.

8. The device of claim 1, wherein each of the source reel and the collecting reel is removably mounted to the frame.

9. The device of claim 1, wherein the transfer roller includes a retractable mounting pin.

10. The device of claim 9, wherein the transfer roller includes a first end and a second end, the retractable mounting pin mounted to the first end.

11. The device of claim 10, wherein the transfer roller includes a slot adjacent the first end, the retractable mounting pin including a handle protruding from the slot.

12. The device of claim 1, including a plurality of transfer rollers, each of the transfer rollers mounted to the frame such that the sheet path encounters a plurality of angular bends between the source reel and the collecting reel.

13. The device of claim 12, wherein at least one of the transfer rollers is selectively removable, and wherein at least a portion of the flexible material is displaceable away from the sheet path in response to removal of the at least one transfer roller.

14. The device of claim 1, the printing press including a press frame, and wherein the frame of the debris screen is defined by a portion of the press frame.

15. A printing press having a debris screen and comprising:

an ink roller train;

a pathway for a paper web;

a source reel, a collecting reel, and at least one transfer roller mounted to a supporting frame; and a sheet of flexible material, the sheet extending along a sheet path from the source reel, over the transfer roller, and to the collecting reel;

the transfer roller positioned on the frame such that the sheet path extends between a portion of the ink roller train and the pathway for the paper web.

16. The device of claim 15, wherein the flexible material is a woven fabric.

17. The device of claim 15, wherein the flexible material is shiftable along the sheet path between the source reel and the collecting reel.

18. The device of claim 17, wherein at least one of the source reel and the collecting reel includes a brake.

19. The device of claim 15, including tensioning means for maintaining a desired tension on the flexible material.

20. The device of claim 17, wherein the source reel includes a friction hub.

21. The device of claim 20, wherein the collecting reel includes a ratchet mechanism.

22. The device of claim 15, wherein each of the source reel and the collecting reel is removably mounted to the frame.

23. The device of claim 15, wherein the transfer roller includes a retractable mounting pin.

24. The device of claim 15, including a plurality of transfer rollers, each of the transfer rollers including a retractable mounting pin.

25. The device of claim 23, wherein the transfer roller includes a slot adjacent the first end, the retractable mounting pin including a handle protruding from the slot.

26. The device of claim 23, wherein an end of the transfer roller defines a cavity, and the mounting pin is mounted to a cylinder reciprocally mounted within the cavity.

27. The device of claim 26, wherein the cylinder is biased toward the end of the transfer roller.

28. The device of claim 15, including a plurality of transfer rollers, each of the transfer rollers mounted to the frame such that the sheet path encounters a plurality of angular bends between the source reel and the collecting reel.

29. The device of claim 15, the printing press including a press frame, and wherein the frame of the debris screen is defined by a portion of the press frame.

30. A method of forming an debris barrier on a printing press, the method comprising:

ascertaining the position of the an ink roller train relative to a pathway for a paper web;

mounting a source reel, a collecting reel, and at least one transfer roller to a frame of the printing press; and routing a sheet of flexible material along a sheet path from the source reel, over the transfer roller, and to the collecting reel; and positioning the transfer roller on the frame such that the sheet path extends between the position of the ink roller train and the pathway for the paper web.

* * * * *